US006150801A

United States Patent [19]

Schwertlein et al.

[11] Patent Number: 6,150,801

[45] Date of Patent: Nov. 21, 2000

[54] REGULATOR APPARATUS

[75] Inventors: Frank-Lothar Schwertlein, München; Michael Lenz, Zorneding, both of Germany

[73] Assignee: Infineon Technologies AG, Munich, Germany

[21] Appl. No.: 09/468,369

[22] Filed: Dec. 20, 1999

Related U.S. Application Data

[63] Continuation of application No. PCT/DE98/01420, May 25, 1998.

[30] Foreign Application Priority Data

Jun. 18, 1997 [DE] Germany ..... 197 25 841

[51] Int. Cl.[7] ..... G05F 1/40

[52] U.S. Cl. ..... 323/280; 323/316

[58] Field of Search ..... 323/273, 274, 323/275, 280, 311, 312, 315, 316

[56] References Cited

U.S. PATENT DOCUMENTS

| | | | |
|---|---|---|---|
| 4,792,747 | 12/1988 | Schroeder | 323/303 |
| 4,906,913 | 3/1990 | Stanojevic | 323/273 X |
| 5,191,278 | 3/1993 | Carpenter | 323/275 |
| 5,625,278 | 4/1997 | Thiel et al. | 323/280 |
| 5,629,609 | 5/1997 | Nguyen et al. | 323/269 |

FOREIGN PATENT DOCUMENTS

0376665A1 7/1990 European Pat. Off. .

*Primary Examiner*—Jessica Han
*Attorney, Agent, or Firm*—Herbert L. Lerner; Laurence A. Greenberg; Werner H. Stemer

[57] ABSTRACT

A regulator includes a first controllable semiconductor component, which has an input terminal connected to a regulator input, an output terminal connected to a regulator output, and a control terminal. A second semiconductor component is provided, which is connected to the control terminal of the first semiconductor component and has an input terminal, an output terminal and a control terminal. A comparison device that has a first input, a second input and an output connected to the control terminal of the second semiconductor component is further provided. A reference voltage can be applied to the first input of the comparison device and the second input is connected to the regulator output. A driver device, which, when a predetermined threshold value is exceeded by an input signal present at the regulator input, diverts part of the current from the control terminal of the first semiconductor component to the regulator output.

14 Claims, 3 Drawing Sheets

REGULATOR APPARATUS

CROSS-REFERENCE TO RELATED APPLICATION

This is a continuation of copending International Application PCT/DE98/01420, filed May 25, 1998, which designated the United States.

BACKGROUND OF THE INVENTION

Field of the Invention

The invention relates to a regulator apparatus, in particular a regulator apparatus with a Darlington structure with a small residual voltage for regulators with a very small voltage drop.

Regulators serve to stabilize a desired value, for example an output voltage or an output current. An actuator, which is usually a (power) semiconductor component in the form of a transistor, is influenced by a manipulated variable derived from the difference between an actual value, for example a specific fraction of the output voltage or of the output current, and the desired value, for example in the form of a reference voltage.

Continuous regulators can be embodied as series or in-phase regulators or as parallel regulators, depending on the configuration of the actuator. In practice, series regulators are used considerably more frequently than parallel regulators. In the case of series regulation or series stabilization, the actuator is connected in series with the load, while the actuator is connected in parallel with the load in the case of parallel regulation or parallel stabilization. Parallel regulators have a lower efficiency than series regulators, since they exhibit a full power consumption in no-load operation as well. A further disadvantage of parallel regulators compared with series regulators is that the transistor used as the actuator has to take up the full output voltage.

SUMMARY OF THE INVENTION

It is accordingly an object of the invention to provide a regulator apparatus that overcomes the above-mentioned disadvantages of the prior art devices of this general type, which has a small power loss, is robust and can be produced in a cost-effective manner.

With the foregoing and other objects in view there is provided, in accordance with the invention, a regulator, including:

- a regulator input;
- a regulator output;
- a first controllable semiconductor component having an input terminal connected to the regulator input, an output terminal connected to the regulator output, and a control terminal;
- a second semiconductor component connected to the control terminal of the first controllable semiconductor component and having an input terminal, an output terminal and a control terminal;
- a comparison device having a first input for receiving a reference voltage, a second input connected to the regulator output, and an output connected to the control terminal of the second semiconductor component; and
- a driver device, which, when a predetermined threshold value is exceeded by an input signal present at the regulator input, diverts part of a current from the control terminal of the first controllable semiconductor component to the regulator output.

The invention is based on the idea of operating the first semiconductor component as a Darlington structure starting from a predetermined limit voltage or threshold voltage present at the regulator input, and, in this way, of considerably increasing the current gain and the efficiency of the regulator.

According to a preferred development, the driver device has a current mirror circuit. This affords the particular advantage that the current gain is limited to values at which the regulating loop operates in a stable manner.

According to a further preferred development, the current mirror circuit has a third and a fourth controllable semiconductor component, whose first main terminals are connected to one another and to the control terminal of the first semiconductor component and whose control terminals are connected to one another. The second main terminal of the third semiconductor component is connected to the regulator output and the second main terminal of the fourth semiconductor component is connected to the one main terminal of the second semiconductor component.

According to a further preferred development, an inverse current blocking device is connected between the output terminal of the first controllable semiconductor component and the current mirror circuit. This affords the particular advantage of preventing inverse operation of the current mirror circuit in the case of a low and negative input voltage at the regulator input, and of enabling a changeover from Darlington operation of the first controllable semiconductor component to normal operation.

According to a further preferred development, the inverse current blocking device is a diode. This affords the particular advantage of easy integration with the remaining semiconductor structures.

According to a further preferred development, the connected control terminals of the current mirror circuit are connected to the control terminal of the first semiconductor component and to the one main terminal of the second semiconductor component.

According to a further development, a resistor or an active current source is connected between the connected control terminals of the current mirror circuit and the control terminal of the first semiconductor component.

According to a further preferred development, a resistor or an active current source is connected between the control terminal of the first semiconductor component and the regulator input.

According to a further preferred development, the first semiconductor component is a lateral pnp transistor.

According to a further preferred development, the two semiconductor components of the current mirror circuit are pnp transistors and the second semiconductor component is a npn transistor.

According to a further preferred development, the comparison device is a differential amplifier.

According to a further preferred development, the differential amplifier is an operational amplifier.

According to a further preferred development, the first input of the comparison device is connected to the regulator output via a voltage divider.

According to a further preferred development, the reference voltage is adjustable.

Other features which are considered as characteristic for the invention are set forth in the appended claims.

Although the invention is illustrated and described herein as embodied in a regulator apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
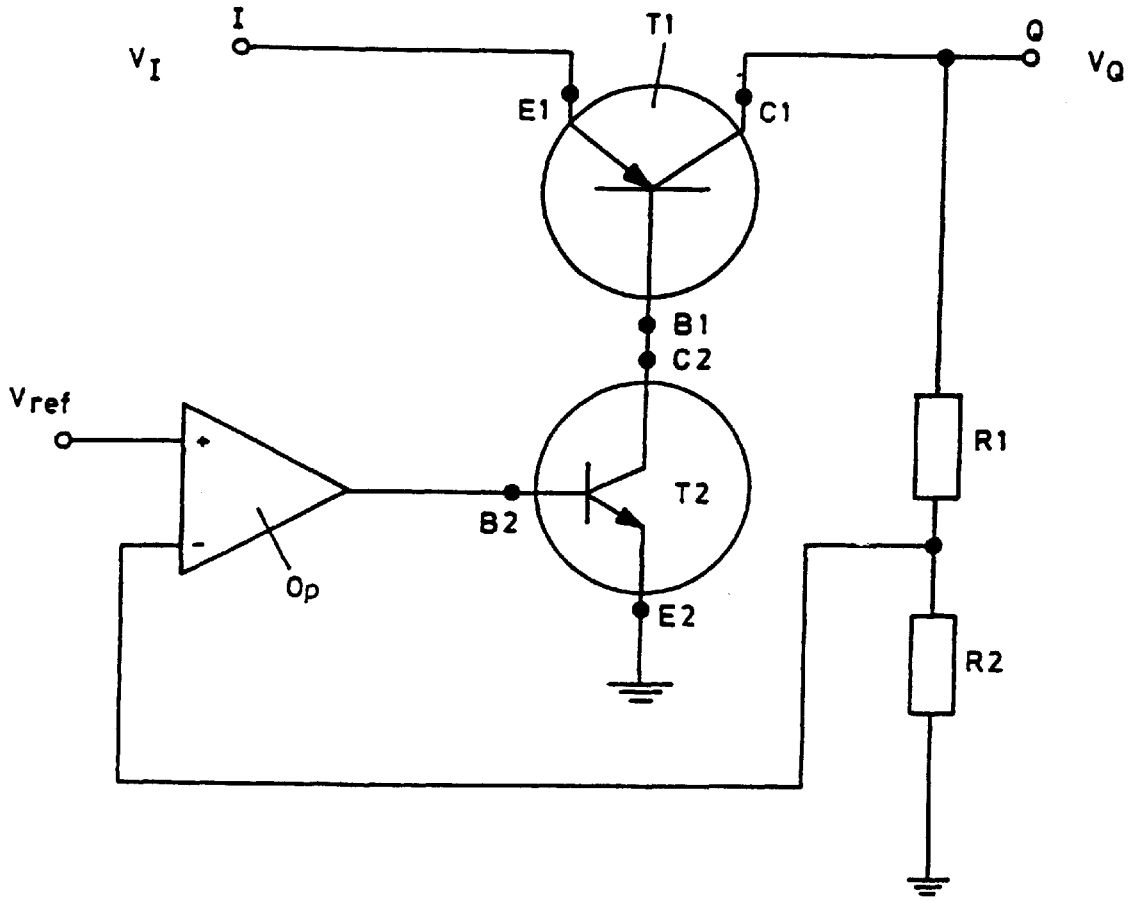
Fig. 1 PRIOR ART
FIG. 1 is a circuit diagram of a prior art continuous serial regulator.

In all the figures of the drawing, sub-features and integral parts that correspond to one another bear the same reference symbol in each case. Referring now to the figures of the drawing in detail and first, particularly, to FIG. 1 thereof, there is shown a basic configuration of a customary continuous series regulator. The regulator has an input I and an output Q. As the actuator, a first controllable semiconductor component T1 in a form of a pnp transistor is connected between the input I and the output Q, an emitter E1 of the transistor T1 is connected to the input I and a collector C1 of the transistor T1 is connected to the output Q. A control or base terminal B1 of the semiconductor component T1 is connected to a collector C2 of a second semiconductor component T2. The second semiconductor component T2 is complementary to the first semiconductor component T1 and is an npn transistor. An emitter E2 of the second semiconductor component T2 is connected to ground M. A control or base terminal B2 of the second semiconductor component T2 is connected to an output of a comparison circuit in the form of an operational amplifier Op. The operational amplifier Op compares a desired value reference voltage Vref present at a first input (+) with an actual value voltage that is tapped off between a resistor R1 and a resistor R2 of a voltage divider. Part of the voltage present at the output Q is fed back as the actual value to the second input (−) of the comparison circuit Op by the voltage divider R1, R2. The comparison circuit Op compares the feedback actual value with the desired value, that is to say the reference voltage present at the second input (+), and outputs a corresponding drive signal to the control terminal B2 of the second semiconductor component T2. The second semiconductor component T2 serves as a driver and amplifies the control current at the control or base terminal of the first semiconductor component T1 as a function of the differential signal at the two inputs of the comparison circuit Op.

As a result, an output voltage VQ at the output Q of the regulator is stabilized in a manner dependent on the reference voltage Vref and the resistances R1, R2:

$$VQ=Vref*(R1+R2)/R2$$

In the case of the regulator shown in FIG. 1, which is produced on a bipolar basis, the pnp transistor is used as the first semiconductor component T1. This transistor T1 is usually constructed as a lateral pnp transistor, that is to say as a bipolar transistor in which the emitter, base and collector are disposed horizontally or laterally and the injection current flows from the emitter to the collector in the lateral direction along the surface of a substrate.

Such lateral pnp transistors are usually fabricated by a double ISO-PNP technology DOPL.

However, the lateral pnp transistors have a relatively small current gain, therefore, the control current of the first semiconductor component T1 serving as the actuator causes high power losses particularly at high input voltages. The poor efficiency and the associated high power losses make it necessary to provide such regulators with power housings for cooling purposes. The power housings that are necessary are expensive and require a great deal of space, thereby preventing miniaturization of the regulator circuit.

In order to avoid these disadvantages, therefore, vertical pnp transistors have recently been used instead of lateral structures for the first semiconductor component T1. The transistors have considerably higher current gains than lateral pnp transistors, particularly at higher currents.

The use of Darlington structures is not put into practice owing to the excessively high drop or drop voltage, that is to say the voltage difference between the emitter and the collector of the Darlington transistor.

One disadvantage with the use of vertical pnp transistors is that fabricating them necessitates a cost-intensive process which is approximately 20–30% more expensive than the fabrication process for lateral pnp transistors. Furthermore, in comparison with lateral pnp transistors, vertical pnp transistors are substantially more sensitive to ambient influences, for example ESD influences, and less robust.

Figure 2:
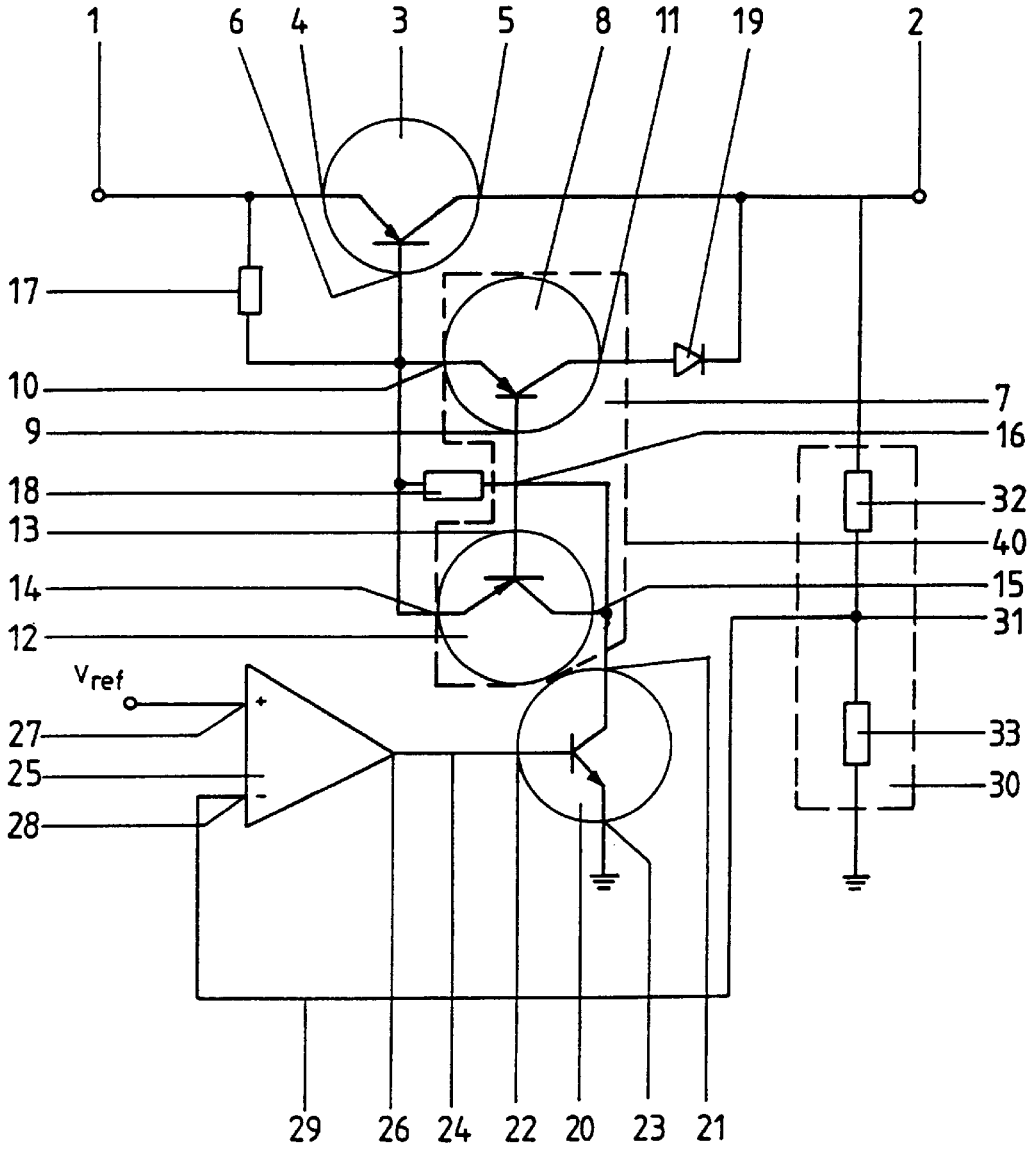
FIG. 2 is a circuit diagram of a preferred embodiment of the regulator according to the invention.

FIG. 2 shows the configuration of a preferred embodiment of the regulator according to the invention. The regulator has a regulator input 1 and a regulator output 2. A controllable semiconductor component 3 is connected between the regulator input 1 and the regulator output 2. The first controllable semiconductor component 3 shown in FIG. 2 is a bipolar lateral pnp transistor. The first semiconductor component 3 has an input terminal 4 connected to the regulator input 1, and an output terminal 5 connected to the regulator output 2. The semiconductor component 3 is controlled by a control terminal 6. The control terminal 6 is a base terminal, the input terminal 4 is an emitter and the output terminal is a collector of the pnp transistor 3.

A driver circuit 40 in the form of a current mirror circuit 7, which is formed by a third controllable semiconductor component 8 and a fourth controllable semiconductor component 12, is connected to the control terminal 6 of the second semiconductor component 3. The third semiconductor component 8 has a control terminal 9, an input terminal 10 and an output terminal 11. The fourth semiconductor component 12 has a control terminal 13, an input terminal 14 and an output terminal 15. The control terminals 9, 13 of the third semiconductor component 8 and of the fourth semiconductor component 12 are connected to one another at a node 16. The third and fourth semiconductor components 8, 12 are each formed by a pnp transistor. The control terminals 9, 13 respectively form base terminals, the input terminals 10, 14 respectively form emitter terminals and the output terminals 11, 15 respectively form collector terminals of the pnp transistors 8, 12.

The control terminal 6 of the first semiconductor component 3 is connected via a resistor or an active current source 17 to the regulator input 1 and the input terminal 4 of the first semiconductor component 3. The control terminal 6 is furthermore connected via a resistor or an active current source 18 to the node 16 and directly to the input terminals 10, 14 of the third and fourth semiconductor components 8, 12 of the current mirror circuit 7.

The output terminal 11 is connected to an inverse current blocking device 19, which is formed of a diode. The anode of the diode 19 is connected to the output terminal 11, that is to say the collector of the third semiconductor component 8, and the cathode of the diode 19 is connected to the output terminal 5, that is to say the collector of the lateral pnp transistor 3, and to the regulator output 2. The inverse current blocking device 19 prevents inverse operation of the third semiconductor component 8 in the case of low or negative input voltages at the regulator input 1 and enables the changeover from Darlington operation of the regulator to normal operation.

The output terminal 15 of the fourth semiconductor component 12 and the node 16 of the current mirror circuit 7 are connected to an input terminal 21 of the second semiconductor component 20. The second semiconductor component 20 has, in addition to the input terminal 21, a control terminal 22 and an output terminal 23.

The second semiconductor component 20 is configured as a bipolar npn transistor and is complementary to the first semiconductor component 3. The input terminal 21 is formed by a collector, the control terminal 22 by a base and the output terminal 23 by an emitter of the bipolar npn transistor. The output terminal 23 is connected to ground.

The control terminal 22 of the second semiconductor component 20 is connected via a drive line 24 to an output 26 of a comparison circuit 25, which is formed by an operational amplifier. The comparison circuit 25 has a first, noninverting input 27 (+) and a second inverting input 28 (−), a reference voltage Vref being present at the first input 27 and the second input 28 being connected via a feedback line 29 to a tapping node 31 of a voltage divider 30. The tapping node 31 is situated between two series-connected resistors 32, 33, the voltage divider resistor 33 being connected between the tapping node 31 and ground and the voltage divider resistor 32 being disposed between the tapping point 31 and the regulator output 2.

Part of the voltage present at the regulator output 2 is fed back via a feedback line 29 to the second input 28 of the comparison circuit 25 by the voltage divider 30.

The comparison circuit 25, which is formed as a differential amplifier, compares a feedback actual voltage value with a reference or desired voltage value present at the first input 27 and controls the control terminal 22 of the second semiconductor component 20 via the control line 24 as a function of the voltage difference present between the inputs 27, 28. The second semiconductor component 20 operates as a current amplifier or driver and controls a base current at the control terminal 6 of the first semiconductor component 3 as a function of the voltage difference between the reference voltage Vref and the regulator output voltage that has been tapped off and fed back.

The current mirror circuit 7 generates a constant current from a reference current and limits the current gain to values at which the regulating loop operates in a stable manner.

If an input voltage Vi present at the regulator input 1 exceeds a predetermined threshold value or a predetermined limit voltage Vg, then part of the current present at the control terminal 6 of the first semiconductor component is directed directly to the regulator output 2 by the driver device 40 disposed between the first semiconductor component 3 and the second semiconductor component 20. After the limit voltage Vg has been exceeded, the first semiconductor component 3 changes over from normal operation to Darlington operation and, together with the third semiconductor component 8, forms a Darlington circuit containing two transistors. The overall current gain is thereby increased.

A power loss Pv in the second controllable semiconductor component 20 is considerably reduced in comparison with a conventional regulator according to the prior art in the case of input voltages lying above the limit voltage Vg. The necessity for a costly and space-consuming cooling device or for a power housing on the regulator according to the invention is obviated in this way.

Figure 3:
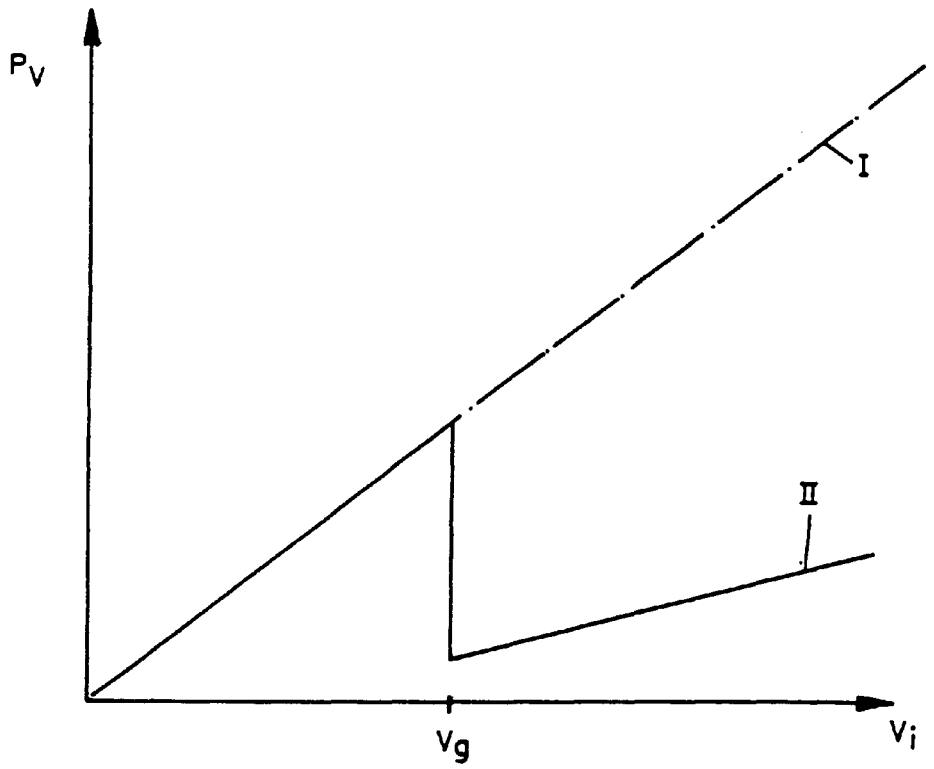
FIG. 3 is a graph showing power losses of the known continuous serial regulator according to FIG. 1 and of the regulator according to the invention as a function of a voltage present at a regulator input.

FIG. 3 shows a comparison of the power loss profile of a conventional regulator and of the regulator according to the invention. The power loss Pv, which is determined by the product of the input voltage Vi and the current intensity at the control terminal 6 of the lateral pnp transistor in FIG. 2 or of the transistor T1 in FIG. 1, rises linearly with an increasing input voltage Vi in the case of the conventional regulator (I). In the case of the regulator (II) according to the invention, the power loss likewise rises linearly up to a limit voltage Vg. When the limit voltage Vg is reached, the regulator according to the invention changes over from normal operation to Darlington operation, and the required base current and thus the power loss initially falls sharply and, as the input voltage Vi increases further, rises linearly but with a smaller gradient than in the case of the conventional regulator.

The invention is not restricted to the embodiment that has been outlined, but rather can be modified in diverse ways within the scope of protection of the patent claims that follow. By way of example, the bipolar transistors illustrated in FIG. 2 may be replaced by field-effect transistors or other controllable semiconductor components. Furthermore, the configuration of the regulator may be complementary to the configuration shown in FIG. 2, that is to say the first, third and fourth semiconductor components 3, 8, 12 are formed by npn transistors and the second semiconductor component 20 is formed by an npn transistor. The reference voltage Vref is adjustable in a further embodiment. Finally, the driver circuit 40 is not restricted to a current mirror circuit, but rather can be formed by any suitable active or passive driver circuit.

We claim:

1. A regulator, comprising:

a regulator input;

a regulator output;

a first controllable semiconductor component having an input terminal connected to said regulator input, an output terminal connected to said regulator output, and a control terminal;

a second semiconductor component connected to said control terminal of said first controllable semiconductor component and having an input terminal, an output terminal and a control terminal;

a comparison device having a first input for receiving a reference voltage, a second input connected to said regulator output, and an output connected to said control terminal of said second semiconductor component; and a driver device, which, when a predetermined threshold value is exceeded by an input signal present at said regulator input, diverts part of a current from said control terminal of said first controllable semiconductor component to said regulator output.

2. The regulator according to claim 1, wherein said driver device has a current mirror circuit.

3. The regulator according to claim 2, wherein said current mirror circuit has a third and a fourth controllable semiconductor component each with a first main terminal connected to one another and to said control terminal of said first controllable semiconductor component and each with a control terminal connected to one another, said third controllable semiconductor component having a second main terminal connected to said regulator output and said fourth controllable semiconductor component having a second main terminal connected to said in put terminal of said second semiconductor component.

4. The regulator according to claim 3, wherein said control terminal of said third controllable semiconductor component and said control terminal of said fourth controllable semiconductor component are connected to said control terminal of said first controllable semiconductor component and to said input terminal of said second semiconductor component.

5. The regulator according to claim 3, including a component selected from the group consisting of a resistor and an active current source connected between said control terminal of said third controllable semiconductor component, said control terminal of said fourth controllable semiconductor component and said control terminal of said first controllable semiconductor component.

6. The regulator according to claim 3, wherein said third controllable semiconductor component and said fourth controllable semiconductor component are pnp transistors and said second semiconductor component is an npn transistor.

7. The regulator according to claim 2, including an inverse current blocking device connected between said output terminal of said first controllable semiconductor component and said current mirror circuit.

8. The regulator according to claim 7, wherein said inverse current blocking device is a diode.

9. The regulator according to claim 1, including a component selected from the group consisting of a resistor and an active current source connected between said control terminal of said first controllable semiconductor component and said regulator input.

10. The regulator according to claim 1, wherein said first controllable semiconductor component is a component selected from the group consisting of a lateral pnp transistor and a DMOS transistor.

11. The regulator according to claim 1, wherein said comparison device is a differential amplifier.

12. The regulator according to claim 11, wherein said differential amplifier is an operational amplifier.

13. The regulator according to claim 1, including a voltage divider, and said second input of said comparison device is connected to said regulator output via said voltage divider.

14. The regulator according to claim 1, wherein the reference voltage is adjustable.

* * * * *